United States Patent [19]

Nishibayashi et al.

[11] Patent Number: 4,954,411

[45] Date of Patent: Sep. 4, 1990

[54] STATIC LATENT IMAGE DEVELOPMENT TONER

[75] Inventors: Katsumi Nishibayashi, Hirakata; Takashi Teshima, Ibaraki, both of Japan

[73] Assignee: Mita Industrial Co., Ltd., Osaka, Japan

[21] Appl. No.: 318,251

[22] Filed: Mar. 3, 1989

[30] Foreign Application Priority Data

Mar. 11, 1988 [JP] Japan ..... 63-59135
Jun. 24, 1988 [JP] Japan ..... 63-157465

[51] Int. Cl.[5] ..... G03G 9/08; G03G 9/10

[52] U.S. Cl. ..... 430/111; 430/109; 430/903

[58] Field of Search ..... 430/109, 111, 903

[56] References Cited

U.S. PATENT DOCUMENTS

| | | | |
|---|---|---|---|
| 3,997,688 | 12/1976 | Gundlach et al. | 430/103 |
| 4,105,320 | 8/1978 | Bean | 101/DIG. 37 |
| 4,197,331 | 4/1980 | Gundlach et al. | 430/126 |
| 4,205,322 | 5/1980 | Tsuzuki et al. | 346/157 X |
| 4,395,472 | 7/1983 | Robillard | 430/47 |
| 4,402,000 | 8/1983 | Fabel et al. | 346/155 |

*Primary Examiner*—Roland E. Martin

*Attorney, Agent, or Firm*—Beveridge, DeGrandi & Weilacher

[57] ABSTRACT

There is described a novel toner for developing static latent image, of which relaxation time is adjusted to 5 through 20 milliseconds at 100 KHz of frequency. The toner is perfectly compatible with cleaning requirements, and thus, fusion or filming of toner onto the surface of photoreceptor is secured prevented, so that clear and distinct image can be securely produced for a long time.

11 Claims, 5 Drawing Sheets

STATIC LATENT IMAGE DEVELOPMENT TONER

FIELD OF THE INVENTION

The present invention relates to toner used for developing static latent image, more particularly, to toner used for developing static latent image generated by the electronic photography, static image printing, or static image recording process or the like.

BACKGROUND OF THE INVENTION

Conventionally, in order to visualize latent image generated on the photoreceptor of an electronic photographic copying apparatus through dry development (where the photoreceptor is provided with photoreceptive layer composed of inorganic or organic photoconductive material), a variety of powder toners containing coloring agents and bonding resin are widely used.

When executing the electronic photography, static latent image generated on the photoreceptor by applying charge and light-exposure is developed by the toner. The toner image generated in correspondence with the static latent image is transferred onto the copying paper, and then, toner image is fixed to the copying paper via the fixation roller like a heated roller or a pressurized roller for example, whereby the static latent image is visualized. After transferring the toner image onto a copying paper, residual toner is scraped off from the surface of the photoreceptor with a cleaning blade.

Recently, from the viewpoint of high sensitivity in the visual-ray region, surpassing durability and wear-resistance, and satisfactory compatibility with high-speed copying operation, application of a photoreceptor having a photoreceptive layer composed of amorphous silicon is proposed. The superficial potential of the proposed amorphous silicon photoreceptor is largely dependent on the thickness of the photoreceptive layer. If the layer thickness were strengthened for increasing the superficial potential, crystals significantly grow. This in turn degrades the uniformity of the surface of the photoreceptor itself. To prevent this, normally, the amorphous silicon photoreceptor is provided with 5 through 60 micrometers of the photoreceptive layer thickness for example within a scope that can preserve the uniformity of the surface of the photoreceptor without degradation. Nevertheless, even though the layer thickness were strengthened, the photoreceptive layer may easily generates uneven portion like pin holes, and yet, since the surface of the amorphous silicon photoreceptor bears low potential, the surface is adversely affected by environmental moisture. To eliminate those disadvantages, Japanese patent application Laid-Open No. 61-284771 (1986) proposes a toner for use with the amorphous silicon photoreceptor having low superficial potential, where the proposed toner has 50° through 70° C. of the glass-transferrable temperature and contains special polyester resin which absorbs less volume of moisture.

The proposed toner surpasses others in the moisture resistance and resistance against friction charge. However, in order to use the photoreceptor in specific regions where the toner characteristic remains stable, if the proposed toner were applied to the amorphous silicon photoreceptor having increased layer thickness, since the surface of the amorphous silicon photoreceptor is uneven, toner fuses itself with the photoreceptor and gradually grows itself, and finally, "toner filming" symptom will occur. More particularly, adhesion between the photoreceptor and the toner is largely dependent on the Coulomb's force generated by the superficial potential of static latent image on the photoreceptor and the amount of charge borne by the toner itself. The magnitude of the adhesion of amorphous silicon photoreceptor having low superficial potential is mainly dependent on the amount of charge borne by the toner. Accordingly, if the cleaning operations with residual-toner-scraping blade were repeatedly performed against image-generating apparatus using electronic photography, pressure generated by the blade and the friction heat between the surface of the photoreceptor and the blade adversely affect the toner adhered to the photoreceptor by the influence of the Coulomb's force. Furthermore, due to uneven surface of the amorphous silicon photoreceptor and sizable amount of charge borne by the toner, compatibility of the toner with the cleaning is lowered. As a result, the toner is fused to the photoreceptor, thus easily generating filming symptom. This not only results in the short service life of the toner and developing agent, but it also causes the toner to generate black spots and streaks of the toner on the copied image, thus significantly degrading the quality of the reproduced image. Furthermore, since the superficial potential of the amorphous silicon photoreceptor is very low, unstable image is easily generated in the solid portion of the copied image, and as a result, distinct and vivid image can hardly be reproduced on copying papers.

Independent of the proposed toner cited above, in order to promote compatibility of the toner with cleaning process, Japanese patent application Laid-Open No. 61-278861 (1986) proposes a toner for use with the amorphous silicon photoreceptor, where the toner containing polyester resin is added with fine powder of titanic-acid strontium. According to the proposed toner, compatibility with cleaning process can be promoted. However, any of those toners containing resin other than polyester resin is not fully compatible with cleaning process.

Due to satisfactory durability and wear-resistance, amorphous silicon photoreceptor is widely used for a large number of high-speed electrophotographic copying apparatuses, and thus, in addition to the durability against cleaning, quick fixation is also required for amorphous silicon photoreceptors. Accordingly, it is essential for the toner to quickly dissolve itself under low temperature in order that it can securely permeate and fix itself onto copying papers, and yet, dissolved toner should properly agglomerate and maintain satisfactory fixation characteristic without migrating itself onto the fixation roller.

SUMMARY OF THE INVENTION

Main object of this invention is to provide a novel toner available for developing static latent image, which can securely generate distinct and vivid image for a long period of time without generating fusion and filming symptom on the photoreceptor, and yet, without causing black spots/streaks and unstable image to be generated on the copied image, and in particular, features surpassing compatibility with cleaning process even when amorphous silicon photoreceptor is used.

Another object of this invention is to provide a novel toner for developing static latent image, which can quickly be fixed onto copying papers and is suited for performing high-speed copying operation.

According to this invention, there is provided a novel toner for developing static latent image, which at least contains coloring agents and bonding resins, and has 5 through 20 milliseconds of relaxation time at 100 KHz of frequency.

Concretely, according to the result of a variety of tests executed by inventors, when relaxation time of the toner is 5 through 20 milliseconds, the amount of charge borne by the toner is quickly attenuated during a period from the step for developing static latent image to the cleaning step for removing residual toner from the photoreceptor. After very quick attenuation of charge, inventors discovered that Coulomb's force between the static latent image and the toner is diminished while the cleaning was conducted. This effectively prevents the toner of the invention from fusing itself with the photoreceptor and generating "toner filming" symptom.

When the relaxation time of the toner is less than 5 milliseconds, the toner contains negligible amount of charge, and thus, it raises problem in the developing process. Conversely, if the relaxation time is more than 20 milliseconds, compatibility of the toner with cleaning process is lowered.

The relaxation time can properly be adjusted according to the kinds and amount of additive such as coloring agents and bonding resins.

DETAILED DESCRIPTION OF THE INVENTION

The toner wherein the relaxation time is adjusted by the kinds and the amount of added coloring agents is explained below. Example of the coloring agent is pigment such as carbon black, lamp black, chrome yellow, hanza yellow, benzidine yellow, threne yellow, quinoline yellow, Permanent Orange GTR, Pyrazolon orange, vulcan orange, watchung red, permanent red, Brilliant Carmine 3B, Brilliant Carmine 6B, Du Pont Oil Red, Pyrazolone Red, Lithol Red, Rhodamine B lake, Lake Red C, Rose Bengal, aniline blue, ultra marine blue, chalco oil blue, methylene blue chloride, phthalocyanine blue, phthalocyanine green, malachite green oxalate, etc., or oil-soluble dyes such as C.I. Solvent Yellow 60, C.I. Solvent Red 27, C.I. Solvent Blue 35, etc. One or more than two kinds of these coloring agents are applicable by blending.

To properly adjust the relaxation time, among those coloring agents, electroconductive coloring agents are preferably used, in particular, carbon black having 10 through 100 millimicrons of particle diameter for example. Concretely, the toner has a tendency to shorten the relaxation time relative to the growth of the content and the electroconductivity of carbon black. Accordingly, in order to properly adjust the relaxation time of the toner by adding a small amount of carbon black, electroconductive carbon black should preferably be used.

Figure 1:
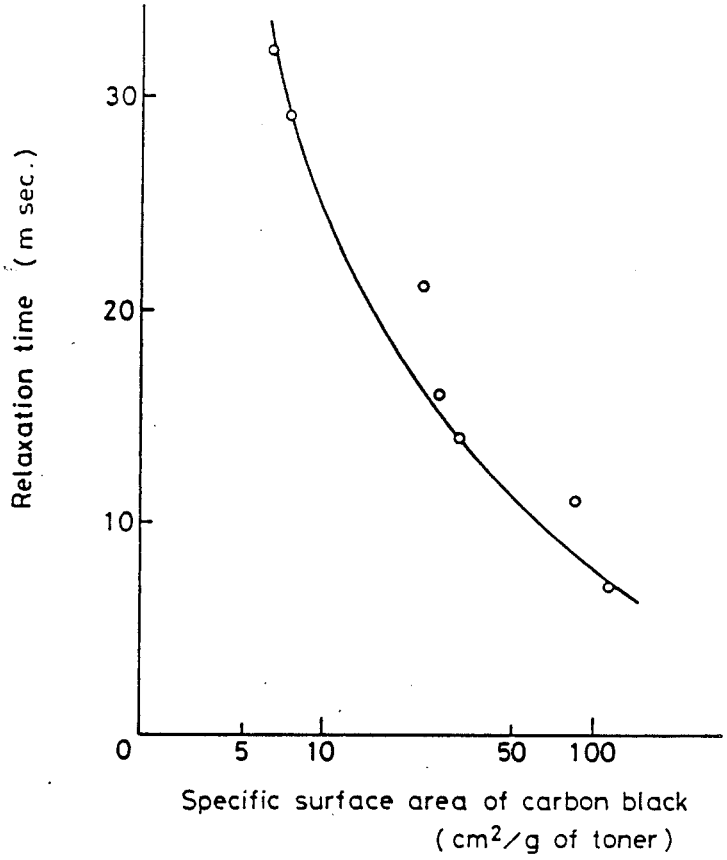
FIG. 1 is the graphical chart representing the relationship between the specific surface area of carbon black used as coloring agent and relaxation time.

As shown in FIG. 1, the toner has a tendency to shorten the relaxation time relative to the growth of the specific surface area of carbon black present in 1 gram of toner. It is clear from the chart shown in FIG. 1 that, in order to adjust the relaxation time of the toner within 5 through 20 milliseconds, carbon black should be added to the toner so that the specific surface area of carbon black can become more than 15 $cm^2/g$ in each one gram of the toner. If the specific surface area of carbon black were less than 15 $cm^2/g$ in each one gram of toner, then the toner cannot fully be compatible with the cleaning process.

The specific surface area of carbon black per 1 gram of the toner can optionally be set in accordance with the specific surface area and the content of the carbon black being used. Practically, carbon black having 200 through 1,500 $m^3/g$ of BET specific surface area, preferably 250 through 1,500 $m^3/g$ of carbon black, should be added to the toner by 2 through 30% by weight, preferably by 5 through 20% by weight. If the content of carbon black were less than 2% by weight, the toner needs a longer relaxation time, thus lowering compatibility with the cleaning. Conversely, if the content of carbon black exceeds 30% by weight, the toner results in a very short relaxation time, and as a result, the toner cannot contain sufficient amount of cahrge.

If it is necessary for the copying system to use magnetic toner, magnetic material can be used in combination with or instead of pigments and dyes mentioned above. Either magnetic or magnetizable material can be used, and, for example, include ferromagnetic metal or alloy such as iron (ferrite or magnetite), cobalt, nickel, manganese, or compound containing those ferromagnetic metals mentioned above, etc. Any of these magnetic materials has 0.1 through 1.0 micrometers of average particle diameter. One or more than two kinds of magnetic materials can be blended into the toner by a specific amount corresponding to 20 through 75% by weight, preferably by a specific amount corresponding to 40 throught 70% by weight.

Example of the bonding resin to be mixed in the toner is olefinic polymers such as styrene polymer, acrylic polymer, styrene-acrylic copolymer, polyethylene, polyethylene chloride, polpropylene, ionomer, and the following polymers including polyvinyl chloride, polyester, polyamide, polyurethane, epoxy resin, diallylphthalate resin, silicone resin, keton resin, polyvinyl butyral resin, phenolic resin, rosin-denatured phenolic resin, xylene resin, rosin-denatured maleic acid resin, rosin ester, petroleum resin, etc. Of these, styrene polymer, acrylic polymer, or styrene-acrylic copolymer, are suited for use. In particular, bonding resin mainly composed of styreneacrylic copolymer is preferably suited for use.

Of those polymers, polymers generated by radical polymerization are obtained by use of the following unsaturated monomers as starting material. Example of the monomer is (1) styrene monomer such as styrene, -methylstyrene, o-methylstyrene, p-methylstyrene, p-methoxystyrene or p-chlorostyrene, (2) acrylic or methacrylic monomer such as acrylic acid, methyl acrylate, ethyl acrylate, n-buthyl acrylate, isobutyl acrylate, n-octyl acrylate, 2-ethylhexyl acrylate, dodecyl acrylate, stearyl acrylate, cyclohexyl acrylate, phenyl acrylate, 2-hydroxyethyl acrylate, 2-hydroxypropyl acrylate, glycidyl acrylate, diethylaminoethyl acrylate, acrylic amide, acrylonitile, methacrylic acid, methyl methacrylate, ethyl methacrylate, n-butyl methacrylate, isobutyl methacrylate, n-octyl methacrylate, 2-ethylhexyl methacrylate, dodecyl methacrylate, stearyl methacrylate, cyclohexyl methacrylate, phenyl methacrylate, glycidyl methacrylate, 2-hydroxyethyl methacrylate, 2-hydroxypropyl methacrylate, or diethylaminoethyl methacrylate, (3) carbonic acid or carbonic acid alkyl ester having unsaturated double bond, such as maleic acid, fumaric acid, chlotonic acid, or itaconic acid, (4) olefinic monomer such as ehtylene, propylene, or butadiene, (5) polyvinyl acetate, (6) polyvinyl chloride, (7) vinylidene chloride, (8) vinyl pyrolidon, and (9) vinyl naphthalene. One kind or plural kinds of those unsaturated monomers may be used.

Any of the bonding resins mentioned above may have proper molecular weight and distribution of molecular weight. However, in order to promote compatibility of the toner with the cleaning, it is desirable to use any bonding resin having at least one peak value in two regions respectively having $1\times10^3$, through $5\times10^4$ and $5\times10^4$ throught $5\times10^7$ of the molecular weight distribution measured by gel permeation chromatography. On the other hand, any bonding resin which does not have the peak value in those two regions of molecular weight distribution causes the toner to degrade compatibility with the cleaning and easily generate fusion and filming symptom on the surface of the photoreceptor. Any polymer which does not have the peak value in region of $1\times10^3$ through $5\times10^4$ of molecular weight distribution cannot quickly proceed with fusion at the moment of fixation, and thus, heat-fixation characteristic of the toner lowers. In addition, such polymer mentioned above obstructs crushing of the toner when being manufactured. On the other hand, such polymer which does not have the peak value in region of $5\times10^4$ through $5\times10^7$ of the molecular weight distribution causes the melt index value to rise. This in turn lowers the hardness of the toner, and thus, the toner easily adheres to the surface of the photoreceptor. The toner containing selected polymer having peak values in two of the above molecular weight distribution regions has sufficient hardness, low melt-index value, and as a result, rarely adheres to the photoreceptor and has satisfactory compatibility with the cleaning.

The proportion of the above two molecular-weight regions can optionally be determined according to the desired characteristic of the toner to be prepared. Concretely, if polymer having area A in the region $1\times10^3$ through $5\times10^4$ and area B in the region $5\times10^4$ through $5\times10^7$ is at the ratio relationship of A:B=30 through 70: 70 throgh 30, more preferably A:B=50 through 70: 50 through 30, this polymer is suited for application to the toner embodied by the invention. If the ratio exceeds the above range, the toner degrades its compatibility with the cleaning, and easily generates fusion with and filming symptom on the photoreceptor. If the ratio of area A were less than 30, then heat-fixation characteristic of the toner lowers. Conversely, if the ratio of area A exceeds 70, then the hardness of the toner lowers. The area ratio is substantially the area ratio of those two of the molecular weight regions divided by the perpendicular line between the minimal points appearing between each peak value of these two regions and the base line.

To suffice the needs for such polymer having the peak values in two molecular weight regions respectively, in addition to compound composed of properly mixed polymers having peak values in respective molecular-weight regions, such polymers derived from polymerization reaction are also usable.

Unless adversely affecting the proper characteristic of the toner, more than two kinds of mixed polymer may also be used.

To prepare thermally-fixable toner, applicable polymer should have the softening point ranging from 50° C. to a maximum of 200° C., preferably in a range from 70° C. to a maximum of 170° C.

To prepare toner fixable with pressure, those polymers which easily generate plastic deformation are mainly used, which, for example, include olefinic polymer such as polyethylene or polypropylene, polyvinyl acetate, ethylene-vinyl acetate copolymer, etc. Each of those polymers may also contain other polymers such as polystylene hydride or hydro-rosin-ester, or aliphatic, alicyclic, or aromatic petroleum resin, for example.

To control charge to be borne by the toner, charge-control agents can be added to the toner by 0.1 through 5% by weight. The examples of the agent are oil-soluble dyes such as Nigrosine dyes, oil black, or Spiron Black, metalized soap which is substantially metallic salt of naphthenic acid, salicylic acid, 2-ethyl-hexoic acid, fatty acid, resinous acid with manganese, iron, cobalt, zinc, cerium, calcium, and nickel, or metal-containing azoic dyes, pyrimidine compound, or alkylsalicylic acid metallic chelate compound, etc.

Furthermore, in order to prevent the toner from adhering to the fixation roller, it is desirable to add the offset inhibitive agents to the toner by 0.5 through 15% by weight of volume. The example of the inhibitive agent is wax composed of low-molecular-weight polypropylene or low-molecular-weight olefinic polymer composed of olefinic monomer having more than 4 of atomic carbon number, fatty acid amido, silicone oil, etc.

The toner composed of the above selected materials may be provided with adequate hardness. However, in order to prevent the toner from being deformed by the stress arose from the cleaning operation and also from adhering itself to the photoreceptor, and in addition, in order to promote compatibility with the cleaning, desirably, the toner should have more than 12 of Vickers hardness. If the toner had less than 12 of Vickers hardness, the toner easily adheres to the photoreceptor when performing the cleaning. In particular, the toner which contains selected polymers having peak values in two of the molecular weight distribution regions mentioned above and has more than 12 of Vickers hardness is fully compatible with cleaning. The toner composed of the above selected materials may have an adequate melt-index value. However, in order to prevent the toner from fusing itself with the photoreceptor, desirably, the toner should have 5 through 20 g/10 minutes of the melt index at 150° C. under 2,160 grams of load. If the melt-index value were below 5 g/10 minutes, hardness of the toner becomes excessive, and then, fixation characteristic is lowered. Conversely, if the melt-index value exceeds 20 g/10 minutes, the toner deforms itself, it easily adheres to the photoreceptor, and thus, the toner loses compatibility with the cleaning. The powder toner having the above composition has 1 through 30 micrometers of average particle diameter, more desirably, 5 through 25 micrometers of average particle diameter.

Furthermore, in order to minimize static adhesion of the toner onto the photoreceptor and promote the compatibility of the toner with the cleaning, desirably, the powder toner containing the above selected materials should externally be added with the positive-chargeable fine powder and the negative-chargeable fine powder. To suffice the needs for the positive-chargeable and the negative-chargeable fine powders, such fine powder chargeable at the positive or at the negative via friction with the toner or the carrier in the dual-component developing agent can be used. The example of the positive-chargeable fine powder is talc, kaolin, barium nitrate, aluminium silicate, calcium silicate, titanium dioxide, calcium carbonate, antimony trioxide, magnesium oxide, zinc oxide, zirconium oxide, etc. Preferably, at least one selected from a group consisting of aluminium oxide, the above fine powders, particularly hydrophobic silica, treated by silicone oil having amino group, and acrylic resin is used as positive-chargeable fine powder. The positive-chargeable fine powder may have adequate particle diameter within the scope of incurring no damage to the photoreceptor. When selecting acrylic-resin fine powder, desirably, average particle diameter should be in a range from 100 to 250 millimicrons. When selecting the positive-chargeable fine powder other than the acrylic resin, desirably, average particle diameter should be 5 through 100 millimicrons, in particular, it should be in a range from 10 to 30 millimicrons. Preferably, hydrophobic silica should be used for sufficing the needs for the negative-chargeable fine powder. Although the negative-chargeable fine powder should also have adequate particle diameter or the like, desirably, average particle diameter should be 5 through 100 millimicrons, in particular, it should be in a range from 10 to 30 millimicrons.

The weight ratio between the positive and negative-chargeable fine powders can properly be determined according to the particle diameter of the selected fine powders. However, it is preferable that the weight ratio between both is in a range from 1:10 to 5:1 (part by weight), in particular, desirably, both should be used at the relative ratio of 1:5 to 2.5:1 (part by weight). If the weight ratio between the positive and the negative-chargeable fine powders exceeds the above range, it results in difficulty to restrain adhesion of the toner onto the photorecepter so as to promote its compatibility with the cleaning.

Both the positive and negative-chargeable fine powders prepared under the above ratio can be added to powder toner by adequate amount. Preferably, 0.01 through 1 part by weight of both the positive and negative-chargeable fine powders should be added to 100 parts by weight of powder toner. If the added amount were less than 0.01 part by weight, the toner can hardly promote its compatibility with the cleaning. Conversely, if more than 1 part by weight of the positive and negative-chargeable fine powders were added, the toner may easily damage the photoreceptor.

When adding both the positive and negative-chargeable fine powders to the toner, fine powder particles charged at the positive and the negative are combined together by the Coulomb's force which reduces the adhesion between the toner and the photoreceptor. As a result, the toner can improve its compatibility with the cleaning. Furthermore, addition of the positive and negative-chargeable fine powders to the toner promotes flowing characteristic of the toner and developing agent as well, thus improving the chargeable characteristic and image reproducibility of the toner itself.

To protect the photoreceptor and prevent developing agent from degrading physical characteristic, metallic salt of fatty-acid such as zinc stearate, alminium stearate may be added to the toner. Normally, 0.001 through 1 part by weight of the above metallic salt is added to 100 parts by weight of toner.

To improve the flowing characteristic of the toner, the toner surface may be treated with compound having low surface tension, such as silane coupling agent, silicone, or fluorine for example.

Next, the toner of which the relaxation time is adjusted by bonding resin is described below.

The applicable bonding resin is composed of the blends of two kinds of resin. The one is represented by a resin having not more than 13 of the acid value and having at least one peak value in respective regions of the molecular-weight distribution measured by gel-permeation chromatography, where these regions are provided with $1\times10^3$ through $5\times10^4$ and $5\times10^4$ through $5\times10^7$ of the molecular-weight distribution. The other is represented by a resin which has not less than 30 of the acid value, and which has at least one peak value in each of the same two regions of the molecular-weight distribution as described above. The toner of the invention is completed by dispersing coloring agents in the mixture of the above two kinds of resin.

Concretely, the relaxation time of the toner can be adjusted within an adequate range by mixing two kinds of resin having specific acid values different from each other without necessarily adjusting the relaxation time by the added amount of coloring agents. As a result, the prepared toner is quite satisfactory in the developing characteristic and the compatibility with the cleaning.

On the other hand, when adjusting the relaxation time by applying coloring agents, if a large volume of coloring agents were added to the toner, viscosity of the melted toner significantly rises during the fixation process. As a result, fixation effect is sharply lowered. In particular, since the melted toner should quickly permeate the copying paper before fixation takes place when high-speed copying operation is underway, the fixation rate lowers, and thus, melted toner cannot fully be fixed onto the copying paper. On the other hand, the toner having satisfactory fixation characteristic can be produced by properly adjusting the relaxation time by applying bonding resins, and is free from causing the viscosity of the melted toner to increase.

From the same reason as the above-mentioned bonding resins, each resin used for constituting the toner should have the peak value in respective regions of the predetermined molecular-weight distirbution. Since the molecular-weight distribution of two kinds of resin are identical to each other, these two kinds of resin can evenly be mixed together during the melting and blending processes, and thus, the produced toner is provided with the minimal difference of characteristics of each particle.

When formulating the toner related to this invention, one of the two kinds of resin having not more than 13 of the acid value and the other kind having not less than 30 of the acid value are mixed together at 10:1 through 1:1 of the weight ratio, preferably at 8:1 through 2:1 of the weight ratio. If the blend ratio of the resin having not less than 30 of the acid value is in excess of the above range, moisture resistance of the toner lowers to significantly degrade image quality under highly humid environment. Conversely, if the blend ratio of this resin is lower than the above range, it cannot effectively reduce the relaxation time, and it degrades compatibility of the toner with the cleaning. Accordingly, by properly blending both resins within the above weight ratio, the produced toner is quite satisfactory in the moisture resistance and well compatible with the cleaning, and the relaxation time is in a short period of time.

As a resin, for example, stylene-acrylic copolymer, polyester resin or epoxy resin can be selected. Acid value can be adjusted by varying the ratio in polymerizing stylene and acrylic acid, for example. Ideal softening point of these resins ranges from 50° to 200° C., preferably in a range from 70° to 170° C.

The toner related to this invention can be produced by the same manner as the production of the above-mentioned toner whose relaxation time is adjustable by means of coloring agents.

The toner of this invention is effectively used for making up mono-component developing agent or dual-component developing agent. When making up the monocomponent developing agent with the toner, the abovementioned toner can be used as it is. On the other hand, when making up the dual-component developing agent, the toner should be blended with carrier for composing developing agent. Example of carrier is materials having 50 through 2,000 micrometers of particle diameter, which include bare carrier such as glass beads, oxidized or non-oxidized iron powder, or coated carrier such as iron, nickel, cobalt, or ferrite, which are coated with acrylic polymer, fluororesin, styrene-acrlyic copolymer, silicone resin, polyester polymer for example. When preparing the developing agent composed of the toner and carrier, normaly, 2% through 15% by weight of toner is used.

As a photoreceptor for holding the static latent image, any of photoreceptor having inorganic photoreceptive layer which is composed of any of those inorganic materials including selenium, selenium-tellurium, zinc oxide, cadmium sulphide, amorphous silicon, etc., photoreceptor having organic photoreceptive layer including charge-generating materials and charge-transferring materials, and electrostatic recording paper can be employed. Independent of the conventional developing method such as contact system or non-contact system, mono-component developing agent composed of the static-latent-image developing toner is used for developing image by means of fur brush or magnetic brush or by apllying powder clouding. Static latent image is also developed by dual-component developing toner with cascade or magnetic brush. After completing development and transfer of image, either a cleaning blade or fur brush may be used for scraping residual toner from the surface of the photoreceptor.

As mentioned above, since the toner of this invention has a specific relaxation time, when performing cleaning, amount of charge borne by the toner significantly is attenuated, thus Coulomb's force between the photoreceptor and the toner is minimized. As a result, compatibility of the toner with the cleaning is significantly promoted. Consequently, the toner of this invention is totally free from occurrence of fusion and filming symptom, and yet, the toner does not cause even the slightest black spot or streak and unstable image to be generated on the reproduced image. This allows lasting maintenance of distinctly clear image. When the relaxation time of the toner is properly adjusted by blending two kinds of resin having different acid values, the obtained toner is well compatible with the cleaning without addition of a large amount of electroconductive coloring agents. Furthermore, owing to satisfactory fusibility, the toner can be fixed onto the copying paper at low temperature even when high-speed printing is executed, and thus, distinct image can eventually be generated on the copied paper.

The toner of this invention is also ideally suited for developing static latent iamge generated by static recording process. Furthermore, since the toner is well compatible with the cleaning and generates distinct image which lasts for a long time, it is particularly suited for generating after removing residual toner from the durable amorphous-silicon photoreceptor, although this photoreceptor has uneven surface layer and low superficial potential and easily generates filming symptom.

EXAMPLE

Hereinafter, this invention will be described with reference to examples and comparative examples.

Example 1

After the following ingredients were melted and dispersed in the heated roll mill, the obtained solid was ground, and then classified, whereby powder toner having 5 through 20 micrometers of average particle diameter was prepared.

(1) 88.7 parts by weight of stylene-acrylic copolymer (a product of Mitsui-Toatsu Chemical Industrial Co., Ltd., Tokyo, Japan) as a bonding resin.

(2) 8.5 parts by weight of carbon black ("PRINGTEX 90", a product of Degussa Co., Inc., having 300 $m^3/g$ of BET specific surface area) as a coloring agent.

(3) 1.8 parts by weight of polypropylene ("BISCOL 550P", a product of Sanyo Chemical Industrial Co., Ltd., Kyoto, Japan) as an offset inhibiting agent.

(4) 1.0 part by weight of charge-controlling agent ("SPIRON Black TRH", a product of Hodogaya Chemical Co., Ltd., Tokyo, Japan).

Figure 2:
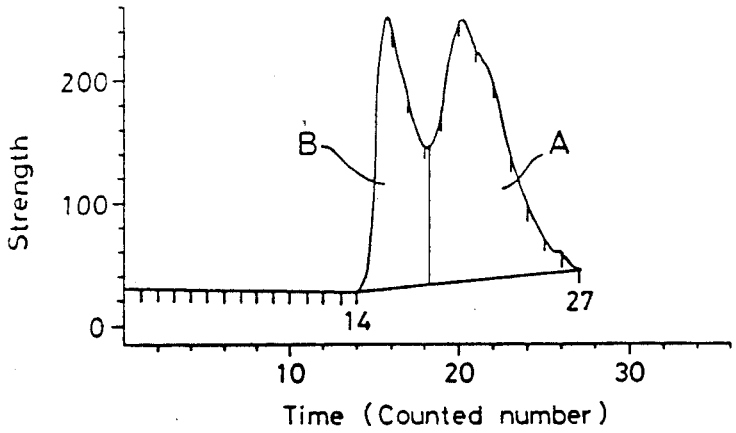
FIGS. 2 through 7 are respectively the graphical charts representing the distribution of molecular weight measured by gel-permeation chromatography in connection with bonding resins used in Examples and Comparative Examples.

The state of the molecular-weight distribution of the bonding resin is shown in FIG. 2. In FIG. 2, Region A having $8.8\times10^2$ through $2.85\times10^4$ of molecular weight had the peak value having $9.54\times10^3$ of molecular weight. Region B having $2.85\times10^4$ through $1.28\times10^7$ of molecular weight had the peak value having $2.06\times10^5$ of molecular weight. The area ratio between regions A and B was A:B 61.7:38.3. Average molecular weight by weight of region A was $8.93\times10^3$ ($Mw/Mn=1.79$), where Mw designates average molecular weight by weight and Mn average molecular weight by number). On the other hand, average molecular weight by weight of region B was $1.97\times10^5$ ($Mw/Mn=2.19$).

A total of 0.4 part of fine powder consisting of the following powders was added to 100 parts of the toner thus prepared. (1) 25% by weight of methyl methacrylate powder having 0.14 micrometers of average particle diameter used for the positive-chargeable fine powder, and (2) 75% by weight of hydrophobic silica having 16 millimicrons of average particle diameter ("AEROSIL R 972", a product of Japan Aerosil Co., Ltd.). Also, dual-component developing agent was prepared by uniformly belnding 4.5 parts by weight of the obtained toner with 95.5% by weight of ferrite carrier powder having 50 through 80 micrometers of average particle diameter in the ball mill.

Example 2

Using stylene-acrylic copolymer (a product of Mitsui-Toatsu Chemical Industrial Co., Ltd., Tokyo, Japan) in place of the stylene-acrylic copolymer used for Example 1, the toner and the developing agent were prepared by applying the same procedure as in Example 1.

Figure 3:
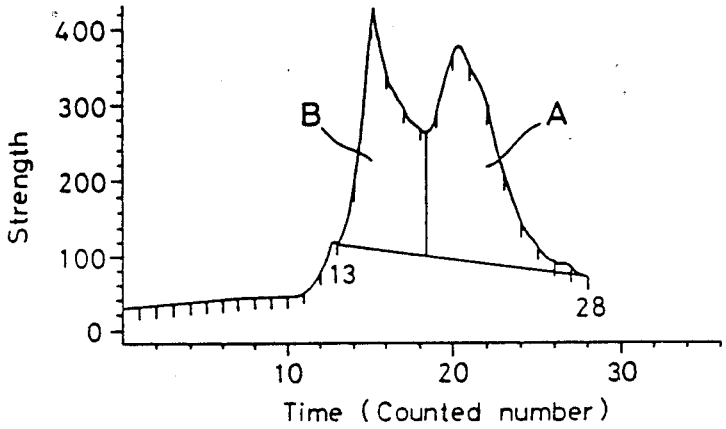

The state of the molecular-weight distribution of the above-cited bonding resin is shown in FIG. 3. In FIG. 2, Region A having $6.2\times10^2$ through $2.82\times10^4$ of molecular weight had the peak value having $9.71\times10^3$ of molecular weight. Region B having $2.82\times10^4$ through $1.73\times10^7$ of molecular weight had the peak value having $4.29\times10^5$ of molecular weight. The area ratio between regions A and B was A:B=57.0:43.0. Average molecular weight by weight in region A was $9.07\times10^3$ (Mw/Mn=1.78). On the other hand, average molecular weight by weight in region B was $5.21\times10^5$ (Mw/Mn=4.83).

Example 3

Using the following fine powder in place of the positive and negative-chargeable fine powders used in Example 1, the developing agent was prepared by adding 0.2 parts by weight of the following fine powder to 100 parts by weight of the toner prepared by applying the same procedure as in Example 1.

(1) 33.3% by weight of the positive-chargeable fine powder composed of aluminium oxide ("Aluminium Oxide C" having about 20 millimicrons of average particle diameter, a product of Japan Aerosil Co., Ltd.).

(2) 66.7% by weight of the negative-chargeable fine powder composed fo hydrophobic silica used in Example 1.

Comparative Example 1

Applying the same procedure as in Example 1, and using the following ingredients (1) to (4), powder toner having 5 through 20 micrometers of average particle diameter was prepared.

(1) 87.7 parts by weight of stylene-acrylic copolymer (a product of Mitsui-Toatsu Chem. Ind. Co., Ltd.) as a bonding resin.

(2) 8.5 parts by weight of carbon black ("PRINGTEX L" having 150 $m^3/g$ of BET specific surface area, a product of Degussa Co., Inc.).

(3) 1.8 parts by weight of polypropylene ("BISCOL 550P", a product of Sanyo Chem. Ind. Co., Ltd.) used Example 1.

(4) 2.0 parts by weight of charge controlling agent ("SPIRON Black TRH", a product of Hodogaya Chem. Ind. Co., Ltd.) used for Example 1.

Figure 4:
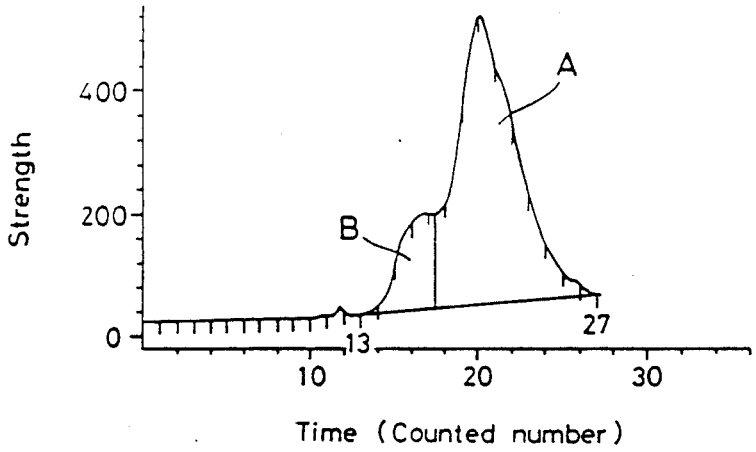

The state of the molecular weight distribution is shown in FIG. 4. Region A having $4.6\times10^2$ through $4.89\times10^4$ of molecular weight had $1.06\times10^4$ of the peak value. Region B having $4.89\times10^4$ through $4.82\times10^8$ of molecular weight had $7.54\times10^4$ of the peak value. The area ratio between regions A and B was A:B =84.3:15.7. Average molecular weight by weight in region A was $1.12\times10^4$ (Mw/Mn=2.04). On the other hand, average molecular weight by weight in region B was $4.75\times10^5$ (Mw/Mn=4.10).

Applying the same procedure as in Example 1, the developing agent was also prepared by adding 0.4 parts by weight of fine powder used for Example 1 to 100 parts by weight of powder toner.

Comparative Example 2

Using stylene - n-butyle methacrylate copolymer in place of the bonding resin used for Example 1, the toner and the developing agent were prepared by applying the same procedure as in Example 1.

Figure 5:
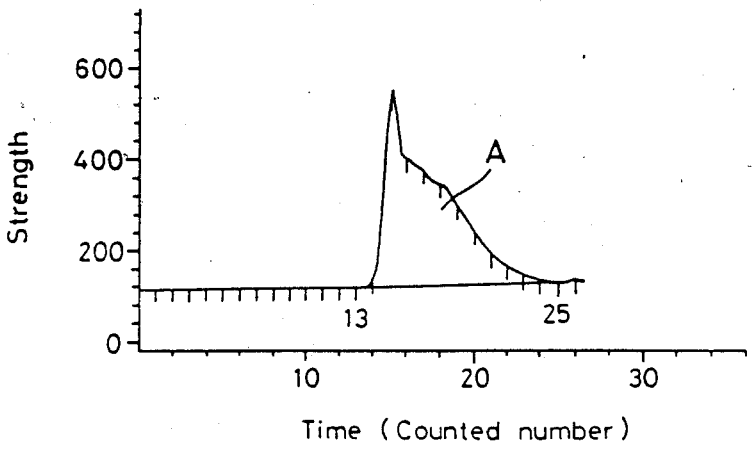

The bonding resin composed of stylene - n-butyle methacrylate copolymer had one peak value in the molecular weight distribution, where, as shown in FIG. 5, there was the peak value having $4.23\times10^5$ of molecular weight in the region having $1.18\times10^3$ through $1.8\times10^7$ of molecular weight. The average molecular weight by weight was $2.25\times10^5$ (Mw/Mn=8.94).

Characteristics of the toners prepared in the above Examples and Comparative Examples were evaluated. In addition, using the prepared developing agent and an electrophotographic copying apparatus (renovated from model DC-4055, a product of Mita Industrial Co., Ltd., Japan), incorporating a photoreceptive drum coated with amorphous-silicon photoreceptive layer, tests for checking durability of printing were conducted to evaluate image characteristic. Results of these tests are shown in Table 1.

In Table 1, Symbol o designates "excellent", symbol o - Δ designates "satisfactory", symbol Δ designates "passable", and symbol x designates "reject", respectively. Melt index was measured at 150° C. in presence of 2,160 g of load.

TABLE 1

| | Example 1 | | | Example 2 | | | Example 3 | | |
|---|---|---|---|---|---|---|---|---|---|
| Characteristic of toner | | | | | | | | | |
| Relaxation time (m sec.) | 18.5 | | | 17.0 | | | 16.5 | | |
| Vickers hardness | 14.5 | | | 15.6 | | | 14.5 | | |
| Melt index (g/10 minutes | 17.0 | | | 8.4 | | | 17.0 | | |
| Image characteristic and toner filming | | | | | | | | | |
| Number of printed paper | Filming | Black streaks | Black spot | Filming | Black streaks | Black spot | Filming | Black streaks | Black spot |
| 1000 pieces | O | O | O | O | O | O | O | O | O |
| 4000 pieces | O | O | O | O | O | O | O | O | O |
| 13000 pieces | O | O | O | O | O | O | O | O | O |
| 20000 pieces | O | O | O | O | O | O | O | O | O |
| 30000 pieces | O | O | O | O | O | O | O-Δ | O | O |
| 60000 pieces | O | O | O | O | O | O | O-Δ | O | O |

TABLE 1-continued

| | Comparative Example 1 | | | Comparative Example 2 | | |
|---|---|---|---|---|---|---|
| Characteristic of toner | | | | | | |
| Relaxation time (m sec.) | 26.0 | | | 45.0 | | |
| Vickers hardness | 11.8 | | | 10.5 | | |
| Melt index (g/10 minutes) | 22.3 | | | 9.4 | | |
| Image characteristic and toner filming | | | | | | |
| Number of printed paper | Filming | Black streaks | Black spot | Filming | Black streaks | Black spot |
| 1000 pieces | O | O | O | Δ-X | Δ | Δ |
| 4000 pieces | O | O | O | X | X | X |
| 13000 pieces | Δ | O | O | — | — | — |
| 20000 pieces | Δ-X | Δ | O | — | — | — |
| 30000 pieces | Δ-X | Δ-X | Δ-X | — | — | — |
| 60000 pieces | — | — | — | — | — | — |

As shown in Table 1, the toner (developing agent) prepare in Comparative Example 1 had 22.3 g/10 minutes of the melt index value at 150° C., 26.0 milliseconds of relaxation time at 100 KHz of frequency, and 11.8 of vickers hardness. Therefore, after completing printing of image on 13,000 pieces of copying papers, the toner excessively adhered to the surface of the amorphous-silicon photoreceptive drum, thus generating filming symptom. After completing printing of image on 30,000 pieces of copying papers, black spots/streaks respectively appeared on the printed image. Likewise, the toner prepared for Comparative Example 2 had 9.4 g/10 minutes of the melt index value at 150° C., 45 milliseconds of relaxation time at 100 KHz of frequency and 10.5 of Vickers hardness. Therefore, after completing printing of image on 1,000 pieces of copying papers, a large number of black spots/streaks respectively appeared all over the surface of the amorphous-silicon photoreceptive drum. After completing printing of image on 4,000 pieces of copying papers, printed image was noticeably stained by large colume of black spots and streaks, and thus the printing tests were discontinued.

On the other hand, the toners prepared for Examples 1 to 3 respectively showed 5 through 20 grames per 10 minutes of the melt index value at 150° C., 15 through 20 milliseconds of relaxation time at 100 KHz of frequency and not less than 12 of vickers hardness. The developing agent prepared for Example 3 merely generated negligible amount of black spots on the surface of the photoreceptive drum after image was printed on the 60,000th copying paper. However, the scope of those negligible black spots appeared on the photoreceptive drum would not raise critical problem in performing actual printing operation. It was confirmed that, after completing printing of image on the 60,000th copying paper, the developing agent prepared for Example 2 did not generate even the slightest black spot on the surface of the photoreceptive drum.

Results of testing the relationship between the acid value of bonding resin and the relaxation time of the toner are described below.

Example 4

After the following ingredients were melted and dispersed in the heated roll mill, the obtained solid was ground, and then classified, whereby powder toner having 5 through 20 micrometers of average particle diameter was prepared.

Figure 6:
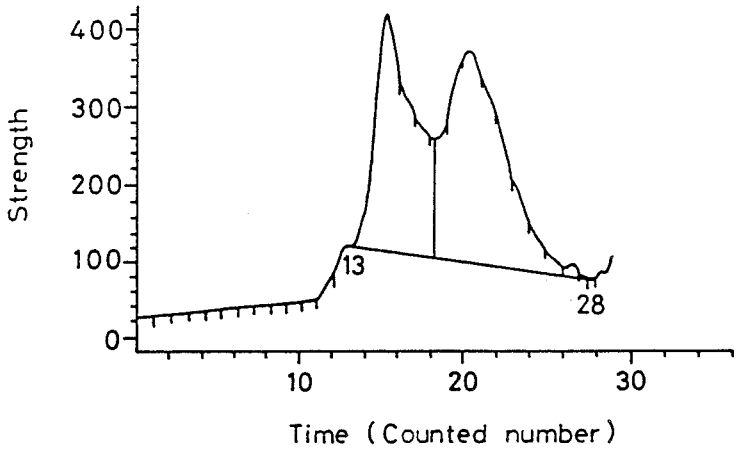
Figure 6:
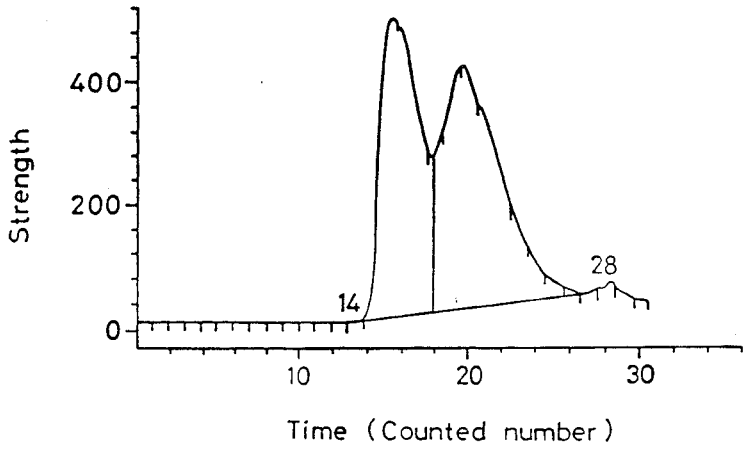

(1) 75 parts by weight of stylene-acrylic copolymer (a product of Mitsui-Toatsu Chem. Ind. Co., Ltd.) as a bonding resin, which has a peak value being $1.3\times10^4$ of molecular weight in a region of $9.0\times10^2$ through $3.9\times10^4$ of molecular weight and another peak value being $6.2\times10^5$ of molecular weight in another region of $3.9\times10^4$ through $1.1\times10^8$ of molecular weight in molecular-weight distribution curve shown in FIG. 6 (*a*) and has 13 of the acid value.

(2) 25 parts by weight of stylene-acrylic copolymer (a product of Mitsui-Toatsu Chem. Ind. Co., Ltd.) as a bonding resin, which has a peak value being $1.4\times10^4$ of molecular weight in a region of $4.0\times10^2$ through $3.8\times10^4$ of molecular weight and another peak value being $2.6\times10^5$ of molecular weight in another region of $3.8\times10^4$ through $2.7\times10^7$ of molecular weight in the molecular-weight distribution curve shown in FIG. 6 (*b*) and has 30 of the acid value.

(3) 6 parts by weight of carbon black ("MONARCH 700", a product of Cabot Co., Inc.).

(4) 2 parts by weight of polypropylene ("VISCOL 550P", a product of Sanyo Chem. Ind. Co., Ltd.) as an offset inhibitive agent.

(5) 1 part by weight of negative dye ("SPIRON Black TRH", a product of Hodogaya Chem. Ind. Co., Ltd.) for controlling charge.

Then, 0.4 part by weight of fine powder composed of the following powders was added to 100 parts by weight of the toner thus obtained.

(1) 25% by weight of poly(methylmethacrylate) fine powder for constituting positive-chargeable fine powder.

(2) 75% by weight of hydrophobic silica ("AEROSIL R 972", a product of Japan Aerosil Co., Ltd.) for constituting negative-chargeable fine powder.

In addition, dual-component developing agent was prepared by uniformly blending 4.6 parts by weight of toner and 95.5 parts by weight of ferrite carrier having 50 through 120 microns of average particle diameter.

Example 5

Applying the same procedure as in Example 4 except for the composition of the toner to which 80 parts by weight of bonding resin having 13 of the acid value and 20 parts by weight of another bonding resin having 30 of the acid value were respectively added, toner was prepared.

Example 6

Applying the same procedure as in Example 4 except for the composition of the toner to which 60 parts by weight of bonding resin having 13 of the acid value and 40 parts by weight of another bonding resin having 30 of the acid value were respectively added. toner was prepared.

Example 7

Applying the same procedure as in Example 4 except for the composition of the toner to which 100 parts by weight of bonding resin having 30 of the acid value was added without using bonding resin having 13 of the acid value, toner was prepared.

Example 8

Applying the same procedure as in Example 4 except for the composition of the toner to which 100 parts by weight of bonding resin having 13 of the acid value and 15 parts by weight of carbon black were respectively added without using bonding resin having 30 of the acid value, toner was prepared.

Example 9

Figure 7:
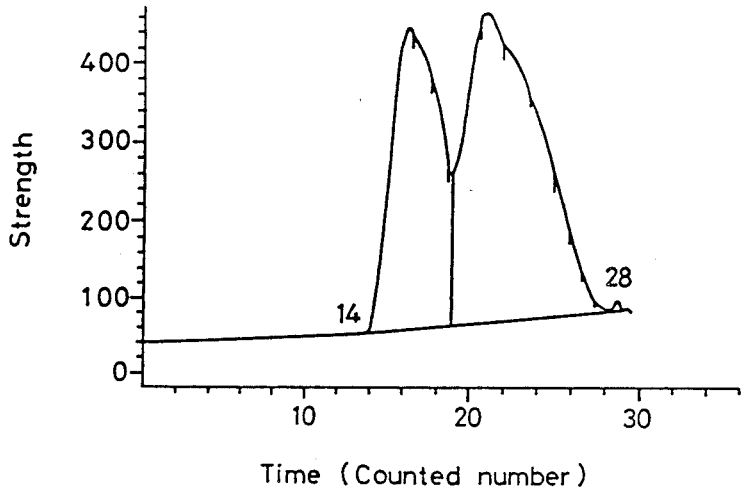

Applying the same procedure as in Example 4 except for the addition of 13 parts by weight of carbon black to 100 parts by weight of bonding resin, and as a bonding resin, stylene-acrylic copolymer (a product of Mitsui-Toatsu Chem. Ind. Co., Ltd.) having a peak value designating $1.3\times10^4$ of molecular weight in a region of $5.1\times10^2$ through $3.8\times10^4$ of molecular weight distribution in GPC curve shown in FIG. 7 and also having 17 of the acid value, toner was prepared.

Comparative Example 3

Applying the same procedure as in Example 4 except for the composition of the toner to which 100 parts by weight of bonding resin having 13 of the acid value and 6 parts by weight of carbon black were respectively added, toner was prepared.

Comparative Example 4

Applying the same procedure as in Example 4 except for the composition of the toner to which 92 parts by weight of bonding resin having 13 of the acid value and 8 parts by weight of another resin having 30 of the acid value were respectively added, toner was prepared.

Relaxation times of the toners prepared in Examples 4 to 9, and Comparative Examples 3 and 4 were measured. Also, the durability of these toners against continuous printing requirements and the fixation characteristic were measured.

The durability of the prepared developing agents against continuous printing requirements was evaluated by actually printing image on 60,000 pieces of copying papers using a high-speed electrophotographic copying appratus incorporating a photoreceptive drum coated with amorphous silicon photoreceptive layer. The copying apparatus renovated from model DC-5585, a product Mita Industrial Co., Ltd., which horizontally transports 55 pieces of A-4 size copying papers per minute. was used. The durability of these developing agents against continuous printing operation was evaluated by analyzing characteristic of the printed image at 25° C./60% RH and also at 35° C./85%RH, respectively.

The fixation characteristic of these developing agent was evaluated by using the DC-5585 renovated copying apparatus and the DC-2055, a product of Mita Industrial Co., Ltd., renovated copying apparatus which horizontally transports 20 pieces of A-4 size copying paper per minute. Surface temperature of each fixation roll is gradually raised by 5° C. from 110° C., and then the toner image was fixed onto the supplied paper. Then, adhesive tape was set onto the fixed image, and then was stripped off, in order to measure the density of the fixed image before and after stripping off the adhesive tape from the fixed image by applying a reflection densitometer (a product of Tokyo Denshoku K.K.), and finally, the fixation rate was calculated by the following formula.

$$\text{Fixation rate (\%)} = \frac{\text{Image density after removing tape}}{\text{Image density before removing tape}} \times 100$$

The temperature at which more than 90% of the calculated fixation rate can be achieved, i.e., the minimum fixation temperature was evaluated. Test results are shown in Table 2.

TABLE 2

| | Example 4 | Example 5 | Example 6 | Exmaple 7 |
|---|---|---|---|---|
| Blend ratio of Resins having different acid values | Acid value 13–75 parts Acid value 30–25 parts | Acid Value 13–18 parts Acid value 30–20 parts | Acid Value 13–60 parts Acid value 30–40 parts | Only 100 parts of resin having 30 of acid value |
| Amount of carbon black added | 6 parts | 6 parts | 6 parts | 6 parts |
| Minimum fixation temperature of C-5585 renovated model printing 55 secs/min. | 170° C. | 170° C. | 170° C. | 170° C. |
| Minimum fixation temperature of C-2055 renovated model printing 20 secs/min. | 160° C. | 160° C. | 160° C. | 160° C. |
| Relaxation time (min · sec.) | 16 | 19 | 11.5 | 9 |

TABLE 2-continued

| | | | | |
|---|---|---|---|---|
| Durability to printing at 20° C./65% RH) | 60,000 pieces - Satisfactory | 60,000 pieces - Satisfactory | 60,000 pieces - Satisfactory | 60,000 pieces - Satisfactory |
| Durability to printing at 35° C./85% RH) | 60,000 pieces - Satisfactory | 60,000 pieces - Satisfactory | 60,000 pieces - Satisfactory | 10,000 pieces - Image became foggy 40,000 pieces - Toner scattered |

| | Example 8 | Example 9 | Comparative Example 3 | Comparative Example 4 |
|---|---|---|---|---|
| Blend ratio of Resins having different acid values | Only 100 parts of resin having 13 of acid value | Only 100 parts of resin having 17 of acid value | Only 100 parts of resin having 13 of acid value | Acid value 13–92 parts Acid value 30–8 parts |
| Amount of carbon black added | 15 parts | 13 parts | 6 parts | 6 parts |
| Minimum fixation temperature of C-5585 renovated model printing 55 secs/min. | 190° C. | 190° C. | 170° C. | 170° C. |
| Minimum fixation temperature of C-2055 renovated model printing 20 secs/min. | 175° C. | 170° C. | 160° C. | 160° C. |
| Relaxation time (min · sec.) | 15 | 18.5 | 30 | 23 |
| Durability to printing at 20° C./65% RH) | 60,000 pieces - Satisfactory | 60,000 pieces -Satisfactory | 10,000 pieces - Filming and black spot/ streak appeared | 15,000 pieces - Filming and black spot/ streak appeared |
| Durability to printing at 35° C./85% RH) | 60,000 pieces - Satisfactory | 40,000 pieces - Image became foggy | 20,000 pieces - Entire image became black-ish | 30,000 pieces - Entire image became black-ish |

Those toners prepared in Examples 4 through 9 had 5 through 20 milliseconds of relaxation time, and as a result, each of these toners successfully contributed to the reproduction of clear and distinct image from the continuous printing. Each of these toners constantly reproduced quite satisfactory image on 60,000 pieces of printed papers at 20°–25° C./65% RH, thus proving sufficient durability to the continuous printing. More particularly, each of these toners proved satisfactory image characteristic and compatibility with the cleaning. After completing series of tests, these toners did not adhere to the photoreceptor at all. Namely, these toners were completely free from filming. Furthermore, even the slightest black spot or black streak was not generated on the printed image at all.

On the other hand, according to the toner of Example 7 which contained only 100 parts by weight of bonding resin having 30 of the acid value, while the test was underway at 35° C./85%RH, foggy symptom appeared on the printed image after printing the 10,000th paper, and thus, printed image lost clearness. The toner scattered itself after the iamge was printed on the 40,000th paper. According to the toner of Example 8 which contained only 100 parts by weight of bonding resin having 13 of the acid value, while the test was underway at 35° C./85%RH, it was confirmed that compatibility of this toner with the cleaning slightly lowered after printing the 40,000th paper. Nevertheless, such slight degradation of the compatibility with the cleaning did not raise problem at all. When the test was underway at 35° C./85%RH using the toner of Example 9 which contained bonding resin having 17 of the acid value, after printing the 40,000th paper, the printed iamge became foggy.

On the other hand, relaxation time of the toners prepared in Comparative Examples 3 and 4 exceeded 20 milliseconds, and as a result, when the test was underway at 20°–25° C./65%RH and 35° C./85%RH, filming symptom started to take place on the surface of the photoreceptive drum after printing the 10,000th or 15,000th paper, whereby black streaks appeared on the printed image. When the trial printing was still followed up growth of black streaks was observed, and then degradation of the printed image quality was promoted. After completing the printing of the 20,000th or the 30,000th paper, blackish shadow covered the entire image.

Regarding the toner fixation characteristic, it was confirmed that, when testing the toners of Examples 4 through 7 by using the copying apparatus capable of printing 55 pieces per minute, more than 90% of the fixation rate was achieved at 170° C. which is the minimum fixation temperature when using this copying apparatus. Normally, the minimum fixation temperature is at 160° C. It is thus clear that toners of Examples 4–7 quickly fix themselves onto the copying papers even when high-speed printing operation is underway. On the other hand, according to the toners of Examples 8 and 9 which contained much volume of carbon black in order to properly adjust the relaxation time, viscosity of the melted toner became high, and in turn caused the minimum fixation temperature to rise. Accordingly, in order to achieve more than 90% of the toner fixation rate under the high-speed printing operation, considerable volume of thermal energy is required. Nevertheless, when performing normal printing operation at a slow speed, there is no problem at all in consideration of thermal energy.

What is claimed is:

1. Static latent image developing toner comprising, at least, coloring agent and bonding resin, and having 5 through 20 milliseconds of relaxation time at 100 KHz of frequency.

2. The static latent image developing toner set forth in claim 1, wherein said coloring agent is carbon black.

3. The static latent iamge developing toner set forth in claim 2, wherein said toner contains said carbon black so that specific surface area of said carbon black is not less than 15 $cm^3/g$ in each 1 g of said toner.

4. The static latent iamge developing toner set forth in claim 3, wherein said toner contains 2 through 30% by weight of said carbon black.

5. The static latent image developing toner set forth in claim 1, wherein positive-chargeable and negative-chargeable fine powders are added.

6. The static latent image developing toner set forth in claim 5, wherein said positive-chargeable fine powder is selected from a group consisting of aluminium oxide, hydrophobic silica treated by silicone oil having amino group and acrylic resin, and wherein said negative-chargeable fine powder is composed of hydrophobic silica.

7. The static latent image developing toner set forth in claim 1, wherein said bonding resin has at least one peak value in each of two regions each having $1\times10^3$ through $5\times10^4$ and $5\times10^4$ through $5\times10^7$ in molecular weight distributions measured by gel-permeation chromatography, and wherein area ratio between said former region having $1\times10^3$ through $5\times10^4$ of molecular weight distribution and said latter region having $5\times10^4$ through $5\times10^7$ of molecular weight distribution is 30 through 70: 70 through 30.

8. The static latent image developing toner set forth in claim 7, wherein said bonding resin is composed of stylene-acrylic copolymer.

9. The static latent image developing toner set forth in claim 1, wherein said toner has not less than 12 of Vickers hardness.

10. The static latent image developing toner set forth in claim 1, wherein said bonding resin is substantially composed of mixture of two resins including the one which has at least one peak value in each of two regions having $1\times10^3$ through $5\times10^4$ and $5\times10^4$ through $5\times10^7$ of molecular weight distributions measured by gel-permeation chromatography and also has not more than 13 of acid value, and the other resin which has at least one peak value in each of the same two regions as those of said molecular weight distribution identical and also has not less than 30 of acid value.

11. The static latent image developing toner set forth in claim 10, wherein mixing ratio between said former resin having not less than 13 of acid value and the other latter resin having not more than 30 of acid value is 1:1 through 10:1.

* * * * *

UNITED STATES PATENT AND TRADEMARK OFFICE

CERTIFICATE OF CORRECTION

PATENT NO. : 4,954,411

DATED : September 4, 1990

INVENTOR(S) : Katsumi Nishibayashi, Takashi Teshima

It is certified that error appears in the above-identified patent and that said Letters Patent is hereby corrected as shown below:

ON THE TITLE PAGE, ITEM [75],
IN THE LIST OF INVENTORS:

1. Please delete ", both of Japan" and replace it with;

--Hitoshi Nagahama, Daito;

Takahiro Ishihara, Akashi;

Takafumi Nagai, Higashiosaka, all of Japan.--

Signed and Sealed this

Nineteenth Day of May, 1992

*Attest:*

*Attesting Officer*

DOUGLAS B. COMER

*Acting Commissioner of Patents and Trademarks*